United States Patent [19]

Swift et al.

[11] Patent Number: 4,811,977

[45] Date of Patent: Mar. 14, 1989

[54] LABELED SECURITY SEAL

[75] Inventors: Allan W. Swift, Denville; Frank Venable, Hamburg, both of N.J.

[73] Assignee: E. J. Brooks Company, Newark, N.J.

[21] Appl. No.: 182,333

[22] Filed: Apr. 18, 1988

[51] Int. Cl.[4] ..... G09F 3/03

[52] U.S. Cl. ..... 292/307 A; 156/268; 292/318

[58] Field of Search ..... 292/307 R–309, 292/314–326; 283/81, 101; 156/268, 209, 219–220; 40/630, 299; 29/453, 525

[56] References Cited

U.S. PATENT DOCUMENTS

| | | | |
|---|---|---|---|
| 1,149,461 | 8/1915 | O'Connor et al. | 292/322 |
| 2,645,514 | 7/1953 | Mitchko | 292/307 R |
| 2,969,570 | 1/1961 | Petri et al. | 24/704 X |
| 3,128,114 | 4/1964 | Nierhaus | 292/320 |
| 3,629,034 | 12/1971 | Kupoda | 156/268 X |
| 3,717,369 | 2/1973 | Stoffel et al. | 292/322 X |
| 3,830,538 | 8/1974 | Moberg | 292/322 |
| 3,861,976 | 1/1975 | Gayner et al. | 156/268 X |
| 3,983,645 | 10/1976 | Rycroft | 292/307 A X |
| 4,229,031 | 10/1980 | Guiler | 292/322 |
| 4,306,745 | 12/1981 | Wenk | 292/318 |
| 4,466,160 | 8/1984 | DeLima Castro Netto | 24/30.5 R |
| 4,506,415 | 3/1985 | Swift | 292/318 X |
| 4,506,921 | 3/1985 | Swift | 292/318 X |
| 4,549,063 | 10/1985 | Ang et al. | 219/121.69 |
| 4,562,047 | 12/1985 | Sestak et al. | 292/322 X |
| 4,579,754 | 4/1986 | Maurer et al. | 40/299 X |
| 4,664,432 | 5/1987 | Swift | 292/318 X |
| 4,711,686 | 12/1987 | Instance | 156/268 X |
| 4,726,972 | 2/1988 | Instance | 283/81 X |

FOREIGN PATENT DOCUMENTS

| | | | |
|---|---|---|---|
| 412778 | 2/1946 | Italy | 292/318 |
| 1257556 | 12/1971 | United Kingdom | 292/318 |
| 2121730 | 1/1984 | United Kingdom | 40/299 |

*Primary Examiner*—Lloyd A. Gall
*Assistant Examiner*—Curtis B. Brueske
*Attorney, Agent, or Firm*—John G. Gilfillan, III; Jeremiah G. Murray

[57] ABSTRACT

A security seal having a tag attached to a flat strap at the central portion by a pair of flexible members. The seal is adapted for sealing a box structure or container having a strap in one surface thereof and a hasp attached to the container. The tag extends upwardly so as to be visible against the surface of the hasp and container. Formed in the label and the tag surface, such as by stamping or the like, are a plurality of circular scores randomly positioned. The random positioning may be recorded to provide a means for verification. Any attempt to remove the label from the tag will result in destruction of the label.

4 Claims, 1 Drawing Sheet

LABELED SECURITY SEAL

FIELD OF THE INVENTION

This invention relates to security seals. In particular this invention relates to security seals having labels thereon for providing desired information.

BACKGROUND OF THE INVENTION

The use of security seals is well known. They are necessities in the shipping industry, the precious material and cash industries as well as in the utilities industry to name only a few.

In the shipping industry security seals are used to seal freight cars, truck doors, cargo containers and other cargo structures. In the precious material and cash industries they are used to seal bags for valuables, bags for currency and coins, as well as precious material containers. In the utilities industry such seals are used to seal water meters, gas meters and electric meters as well as other types of equipment. In each of these examples, the seal serves as an indicator of whether or not the seal, and thus the container in sealed devices, has been tampered with or attacked. If a seal or if it can provide an inspector with an indication that the seal has been tampered with or removed so as to put the inspector on guard as to the possibility that the container is not secure, then the seal has been successful.

In addition to a sealing function, security seals also have been utilized as carriers of information. Thus, serialized numbers have been imprinted on the seals to provide identification and correlation information. More recently, labels have been secured to the seals to provide information such as routing, identification and the like.

Two problems have been particularly vexing to those skilled in the labeled seal arts. The first is that nefarious individuals have developed the capability to remove labels from the seal structure and replace them with labels containing incorrect information. For example, where a seal is provided with a label having routing information and the seal used to seal a precious material container, it would be very desirable to a thief to be able to remove the genuine label from the seal and substitute a different label having different routing information. With such a technique the thief might be able to cause a container of precious gems or the like to be delivered to his home rather than to a jewelry store as intended. This undetectable removal of a label from a seal to permit fraudulent replacement has been a serious problem.

A second problem has been difficulty in affixing labels to seals made of certain materials. More specifically, many security seals are made of plastic material such as polypropylene and polyethylene. The usual method of affixing labels to seals is through the use of adhesives. As is well recognized by those skilled in these arts, it is often difficult to get good adhesion with the surface of polyethylene, polypropylene and other plastic surfaces. In the past, manufacturers often resorted to such techniques as corona treating and the like to prepare the plastic for receiving adhesed labels. This approach, however, was expensive and only marginally successful.

As is discussed below in detail the present invention solves the above-described problems and provides an inexpensive, reliable seal with label.

SUMMARY OF THE INVENTION

It is an object of the present invention to provide a seal having a label thereon, which label is virtually impossible to remove and replace without having evidence of tampering.

Another object of the present invention is to provide a plastic seal having a label thereon which is adequately adhesed to the plastic material of the seal.

Yet a further object of the present invention is to provide a seal having a label thereon which is economical to manufacture and easy to use.

These objects and others not enumerated are achieved by the labeled security seal of the present invention, one embodiment of which may include a label secured to a security seal surface and scores formed in said label and said surface of said security seal whereby to reduce the susceptability of such seals to accurate replacement of the label and also to improve the adhesion capability of the label to the seal surface.

BRIEF DESCRIPTION OF THE DRAWING

A more complete understanding of the present invention may be had from the following detailed description, particularly when read in the light of the accompanying drawings wherein.

DETAILED DESCRIPTION

Figure 1:
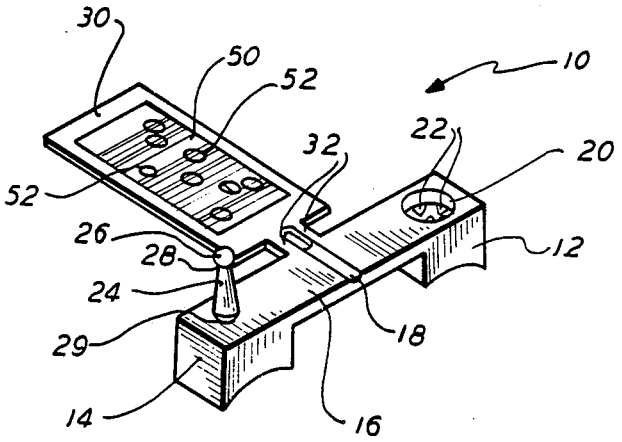
FIG. 1 is a perspective view of a security seal embodying the features of the invention.

The present invention will hereinafter be described in the context of a particular seal, i.e. the seal disclosed in my U.S. Pat. No. 4,664,432. This description however is of a typical embodiment. The invention also has application with respect to seals such as those disclosed in my U.S. Pat. No. 4,506,921 and others.

Referring therefore to the drawings, a labeled security seal structured in accordance with the teachings of the present invention is disclosed and designated generally by reference numeral 10. Seal 10 is preferably formed by injection molding a plastic such as polyethylene or polypropylene and comprises a pair of spaced fasteners support bodies 12 and 14 which are joined by a flat strap 16 which has a section of reduced thickness generally centrally disposed such as to define a hinge 18.

Fastener support member 12 is provided with an opening 20 the axis of which extends generally normal to the plane of flat strap 16 when the seat is in unlocked position (FIG. 1). Disposed within opening 20 are a plurality of resilient fingers 22 which are inclined inwardly and rearwardly to form a locking socket in the manner well known to those skilled in this art.

Fasteners support member 14 is provided with a fastener stud 24 the axis of which is also generally normal to the plane of flat strap 16 when the seal is in unlocked position. Stud 24 has an enlarged head 26 with an abrupt shoulder 28 for locking behind the ends of the fingers 22 in the usual manner when the stud 24 is inserted into the opening 20.

In the disclosed embodiment, stud 24 is provided with a weakened portion 29 at or near the junction with support body 14 in the manner disclosed in my U.S. Pat. No. 4,441,233. The axial dimension of the stud and the socket also conform to the requirements set out in the aforesaid patent, in which the distance from the top of the fastener support body to the shoulder 28 is the same, with allowance for manufacturing tolerances, as the distance from the top of the fastener support body 12 to the ends of the fingers 22.

Seal 10 also includes a tag 30 which is attached to the flat strap 16 at the central portion by a pair of flexible members 32. In the illustrated embodiment, the flexbile members 32 are attached to the strap on opposite sides of the hinge 18 for purposes as discussed hereinafter.

Figure 2:
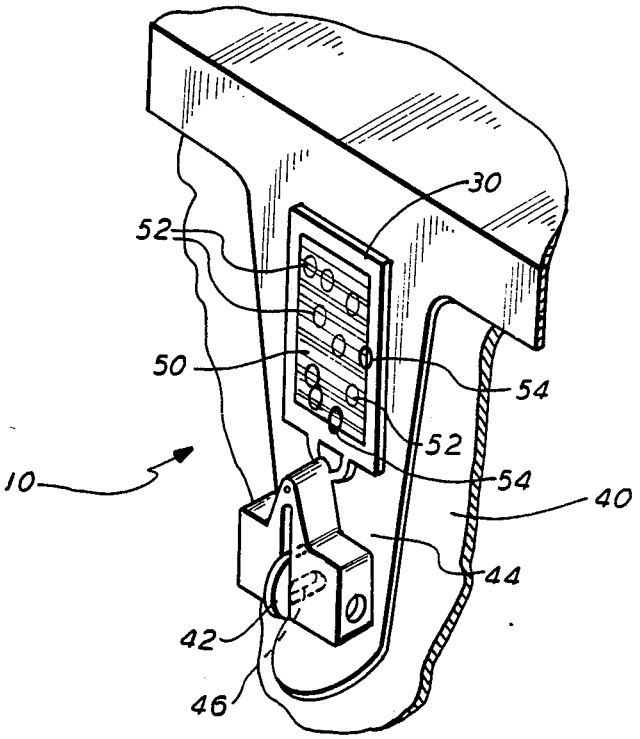
FIG. 2 is a front perspective view of a seal according to the present invention labeling a container closure.

Seal 10 is particularly adapted for sealing a box structure or container 40 which may have a staple 42 in one surface thereof and a hasp 44 attached to the container structure and having a slot 46 positioned to receive the seal when the cover is closed as illustrated in FIG. 2.

In use, seal 10 is folded about hinge 18 such that fastener stud 24 passes through the opening in staple 42 and is rigidly received within opening 20 such as to be retained by resilient fingers 22. With the seal so bent, tag 30 extends upwardly so as to be visible against the surface as the hasp 44 and container 40.

Disposed on the surface of tag 30 is a label 50. Label 50 as disclosed is a typical bar code label however it will be recognized that the label may be of any of the generally recognized and utilized labels in the industry.

Formed in this label such as by stamping or the like are a plurality of scores 52. In the embodiment shown, scores 52 are circular, but as is discussed below, based upon this particular type of label and the particular type of security sought, the scores may be linear or other types of non-linear shape.

Scores 52 are randomly positioned in the label. However such random positioning may be recorded such as to provide a means for verifying the bar code accuracy.

More importantly, however, scores 52 are positioned such that any attempt to remove label 50 from tag 30 will result in destruction of the label. This of course, will result in immediate evidence of tampering.

Scores 52, in addition to scoring labels 50, also may be provided to be of a depth sufficient to cut the surface of tag 30. Scoring to such a depth accomplishes two functions. Initially such scoring provides a marking on the tag which corresponds to the score marking on the label 50. Thus, where the scores extend beyond the edge of the label 50 such as at scores 54, any attempt to relabel must be sufficiently precise as to cause congruency between a new label and the prior scoring on the tag. As will be well recognized by those skilled in the art, such congruency is extremely difficult and attempts to match the congruency are ordinarily unsuccessful thereby providing a visual indication of the attempt to tamper with the seal.

Secondly, scoring to a depth such as to cut the surface of tag 30 provides for a better adhesion between the tag 30 and the label 50. As noted above, the usual method of affixing labels to seals is through the use of adhesives. Providing a satisfactory adhesion between a tag 30 and a label 50 has been difficult where the tag is made of a plastic material such as polyethylene or polypropylene. One reason for this is that the plastic material tends to be unoxidized and have an oily surface which is not susceptible to adhesion. A second reason is that lubricants are sometimes used in injection molding process and such lubricants tend to coat the surface of the tags and reduce the efficiency of adhesion bonding. Other reasons will be recognized by those skilled in these arts.

By scoring label 50, the surface of label 50 comes into contact with the below surface material of tag 30 thus causing an acceptable adhesive bonding. This approach has been found to improve the adhesion between tag and label.

It will be recognized by those skilled in these arts that non-circular scoring may be utilized. Where there is no likelihood of interfering with bar code reading, linear scoring may be utilized.

The labeled security seal of the present invention thus provides a device wherein tampering with an identification label is evident, the possibility of replacing a removed label with an authentic appearing replacement label is reduced, and wherein the adhesion of the label to the tag surface is improved.

It will be recognized, however, that many modifications and variations to the present invention may be made without departing from the spirit and scope thereof.

We claim:

1. A labeled security seal comprising:

a security seal for sealing a container or the like including a surface thereon for receiving a label;

label means secured to said surface of said security seal, said label means for carrying information thereon; and coincident non-linear scores formed in said label means and said surface of said security seal, said scores in said label being spaced such that attempted removal of said label will result in destruction of the label, said coincident scores being randomly spaces such as to render accurate replacement of said label with a substitute label having matching scores without evidence of tampering to be virtually impossible.

2. A labeled security seal according to claim 1 wherein said scores are circular.

3. A labeled security seal comprising:

a security seal for sealing a container or the like including a surface thereon for receiving a label;

label means secured to said surface of said security seal, said label means for carrying information thereon;

coincident scores formed in said label means and said surface of said security seal, said scores in said label being spaced such that attempted removal of said label will result in destruction of the label, said coincident scores being randomly spaced such as to render accurate replacement of said label with a substitute label having matching scores without evidence of tampering to be virtually impossible; and said scores in said security seal extending into the material of said seal below said surface of the seal, said label being in contact with said material below said surface whereby it improves the securing of said label to said seal.

4. A labeled security seal according to claim 3 including adhesive means for securing said label to said seal, said adhesive means extending into said scores in said surface of said security seal.

* * * * *

UNITED STATES PATENT AND TRADEMARK OFFICE

CERTIFICATE OF CORRECTION

PATENT NO. : 4,811,977

DATED : March 14, 1989

INVENTOR(S) : Allan W. Swift et al.

It is certified that error appears in the above-identified patent and that said Letters Patent is hereby corrected as shown below:

Column 1, line 24, after "seal" insert -- is missing --.

Column 2, line 51, "seat" should read -- seal --.

Column 3, line 7, "flexbile" should read -- flexible --.

Column 3, line 20, "as" should read -- of --.

Column 3, line 23, delete "of".

Signed and Sealed this

Nineteenth Day of December, 1989

*Attest:*

JEFFREY M. SAMUELS

*Attesting Officer*

*Acting Commissioner of Patents and Trademarks*